United States Patent [19]

Smalley

[11] 4,244,479

[45] Jan. 13, 1981

[54] TAMPERPROOF CLOSURE MEMBER

[75] Inventor: Ned J. Smalley, Perrysburg, Ohio

[73] Assignee: Owens-Illinois, Inc., Toledo, Ohio

[21] Appl. No.: 968,940

[22] Filed: Dec. 13, 1978

Related U.S. Application Data

[63] Continuation-in-part of Ser. No. 878,138, Feb. 15, 1978, abandoned.

[51] Int. Cl.[3] ..... B65D 41/32

[52] U.S. Cl. ..... 215/256; 215/254; 215/253; 215/274; 220/270

[58] Field of Search ..... 215/253, 254, 256, 274; 220/270

[56] References Cited

U.S. PATENT DOCUMENTS 3,913,771 10/1975 Acton et al. ..... 215/274 X

FOREIGN PATENT DOCUMENTS 1426107 12/1965 France ..... 215/254

*Primary Examiner*—George T. Hall

*Attorney, Agent, or Firm*—John R. Nelson; Myron E. Click; David H. Wilson

[57] ABSTRACT

A tamperproof press-on, snap cap for closing a container having a neck defining the mouth opening. The container has an upper cap retaining bead and lower, enlarged annular ledge. The snap cap includes an enlarged end wall and a downwardly depending skirt inwardly of the end wall periphery which has an inwardly directed radial annular bead for cap retaining engagement with the container bead. A cylindrical tear sleeve depends downwardly from the peripheral edge of the end wall of the cap, is spaced radially outwardly from the skirt, is longer than the skirt and sized for encircling and snugly engaging the annular ledge. The tear sleeve has a peripherally weakened annular tear zone at the cap end wall juncture and includes an axial tear groove extending from the weakened tear zone to the lowered edge of the sleeve. Adjacent the tear groove is shortened section to enable grasping and tearing the sleeve. Two alternative forms of cap end wall are shown, the first a solid end wall providing a one-piece cap, the second, an apertured end wall useable with a two-piece closure wherein an underlying lid seals off the mouth of the container and is held by the overlying cap.

6 Claims, 5 Drawing Figures

TAMPERPROOF CLOSURE MEMBER

CROSS REFERENCE TO RELATED APPLICATIONS

The present invention constitutes a continuation-in-part of copending application Ser. No. 878,138, filed Feb. 15, 1978.

BACKGROUND OF THE INVENTION

This invention pertains to closures embodying tamperproof or tamper-indicating structures and more particularly it relates to a tamperproof structure for a press-on or snap-on type of closure member which incorporates a unique tamper-indicating sleeve which must be physically removed prior to removal of the closure member from the container.

The prior art has included a variety of press-on or snap-on types of closures which incorporate tamper-indicating features. The majority of these patents, however, include a separable tamperproof band formed as an integral part or extension of the container-engaging skirt portion of the closure. Examples of such prior art patents include U.S. Pat. Nos. 3,653,529 (Segmuller), 3,707,240 (Wilson) 3,913,771 (Acton, et al.), and 3,974,932 (Faulstich). One patent in the prior art which incorporates a separate tamperproof band which extends downwardly from the top panel of the closure in U.S. Pat. No. 4,029,231 (Jonsson). According to this latter patent, a tamperproof band, or tear-strip, is located alternatively in the transverse endwall or an outer sidewall of a protective cover which encloses an inner cap, or closure. Upon removal of the tamperproof band for purposes of gaining access to the inner cap, a major portion of the protective cover still remains to be removed and discarded. While such a structure may be effective as a tamperproof closure structure, it is not only somewhat inconvenient to open, but also represents a relatively uneconomical structure, since a major portion of the tamperproof closure is designed to be removed and discarded preparatory to gaining access to the reusable portion of the closure.

SUMMARY OF THE INVENTION

It is, therefore, an object of this invention to provide a unique tamperproof structure for a press-on or snap-on type of closure member wherein the closure member is characterized by having an endwall integrally carrying depending retaining means such as, for example, an annular skirt which is adapted for manually removable snap-fit assembly on a container neck. However, manual removal of the closure member is capable of accomplishment only by exerting axially directed manual force against a selectively restricted portion of the closure member. To this end the endwall of the closure member includes an outer marginal portion which extends laterally outward beyond the retaining means to provide an annular overhang. The overhang thus presents a bearing surface against which manual force may be exerted to remove the closure member from the container neck. As a means of assurance against unsanctioned removal or tampering with the assembled closure member, the bearing surface is protectively enclosed within the interior confines of a depending tamper-indicating sleeve which is interconnected to the outer reaches of the endwall along a selectively weakened web section. The tamper-indicating sleeve is manually separable from the endwall along the selectively weakened web section, and must be so separated, in order to permit manual access to the bearing surface for removal of the closure member from the container neck. Once the tamper-indicating sleeve has been separated from the endwall, the bearing surface will be exposed and manually accessible to accommodate removal of the closure member from the container neck. In accordance with this invention, the entire tamper-indicating sleeve is permanently removable from the closure member to provide easy manual access to the bearing surface. Moreover, since the tamper-indicating sleeve is not directly interconnected to the retaining means, the latter remains intact with the endwall to permit reuse of the closure member on the container. As another feature, the tamper-indicating sleeve of this invention incorporates at least one one major tear groove leading from the lower extremity of the sleeve to the weakened web section. This tear groove facilitates access to a recessed portion of the tamper-indicating sleeve to accommodate grasping and severing of the sleeve from the endwall along the weakened web section. Thus, the unique tamper-indicating sleeve in this invention isolates the bearing surface within its interior confines and renders the bearing surface inaccessible for manual removal of the closure member prior to separation of the tamper-indicating sleeve from the endwall of the closure member. No less importantly, the tamper-indicating sleeve of this invention provides an effective tamper-indicating device, as its unimpaired presence assures the consumer that the closure member has not been previously removed from the container.

Other objects, features, and advantages of this invention will become obvious to one ordinarily skilled in the art to which it pertains upon reference to the following detailed description of the preferred embodiments taken in conjunction with the drawings illustrating the same.

IN THE DRAWINGS

DETAILED DESCRIPTION OF THE PREFERRED EMBODIMENT

Figure 1:
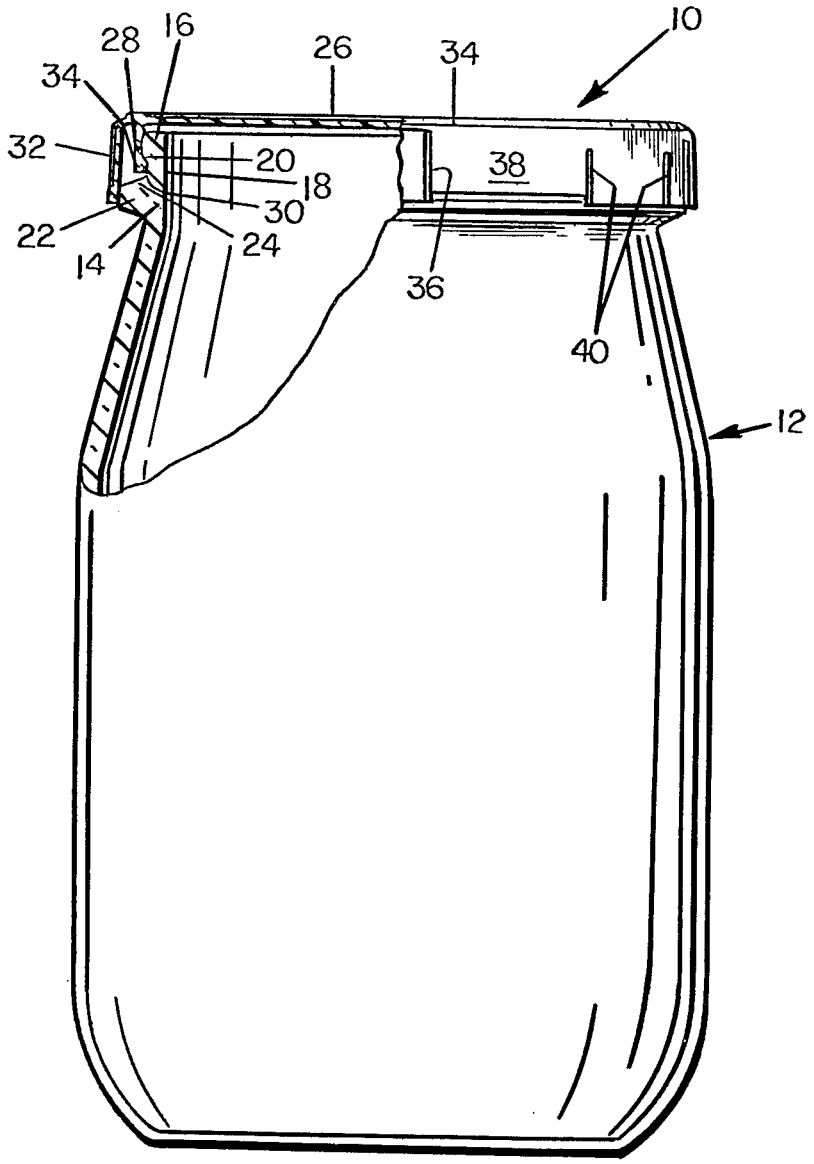
FIG. 1 is a front, partially sectionalized, elevational view of one preferred form of tamperproof closure member shown in press-on assembled relationship on a suitable container and embodying the tamperproof or tamper-indicating features of this invention.

Referring now to the drawings, FIG. 1 depicts a unique tamperproof closure member, indicated generally by the numeral 10, assembled in sealing engagement on the neck of a container, represented generally by the numeral 12. The container 12 may be of any suitable type and may be formed from either glass or plastic. The container 12 includes a neck portion 14 terminating at its upper extremity in an annular rim 16 which defines the periphery of an open mouth at 18, through which the contents of the container may be dispensed. The container neck portion 14 includes on its outer surface a peripherally raised, or enlarged, closure-retaining bead 20 and a peripherally enlarged ledge 22, between which is formed an outwardly facing peripherally recessed portion 24.

Figure 2:
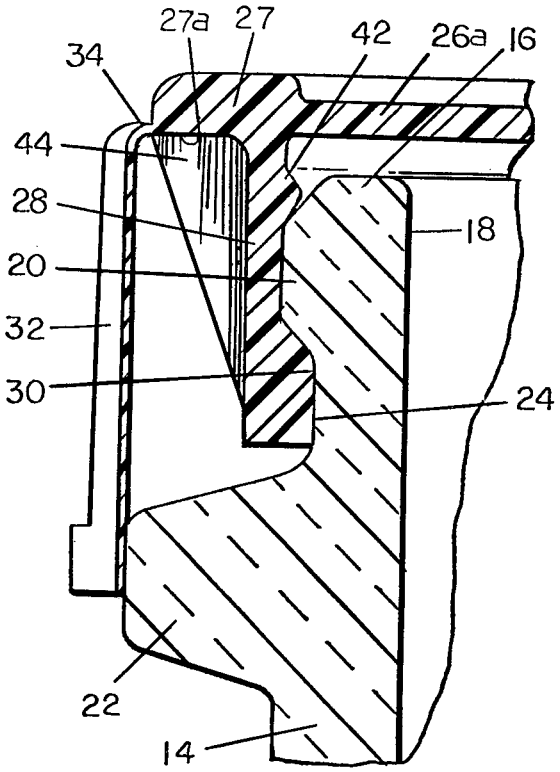
FIG. 2 is a substantially enlarged fragmentary sectional view of the tamperproof closure member shown in FIG. 1.
Figure 3:
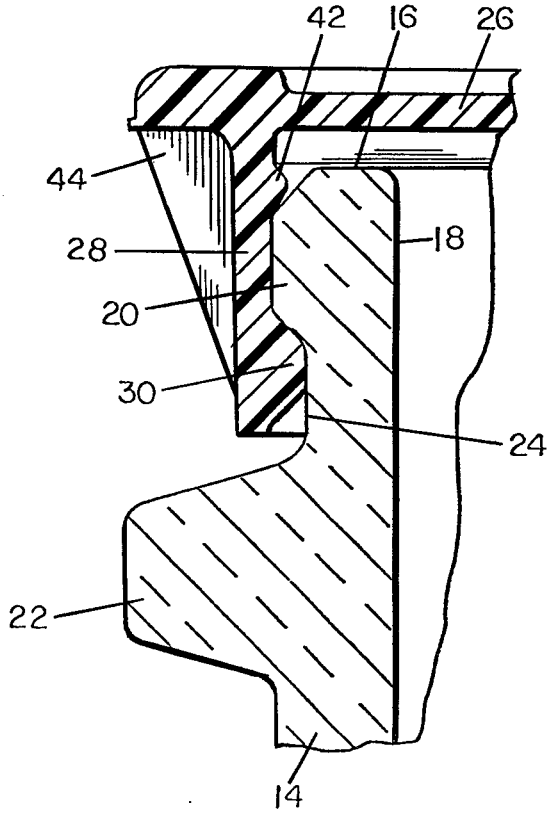
FIG. 3 is another fragmentary sectional view similar to FIG. 3, but for comparative purposes showing the tamperproof closure member after the tamper-indicating sleeve has been removed.

The unique closure member of this invention, as indicated in the embodiment thereof shown in FIGS. 1–3, may take the form of a snug-fitting, one-piece, press-on type of closure member such as, by way of a preferred example, among others, a snap cap having an endwall, or top panel, 26 comprising an outer marginal portion and an imperforate central panel **26*a* which spans the open mouth 18 of the container 12 and integrally converges into the outer marginal portion to provide an integral one-piece, endwall structure. Retaining means for retaining the closure member in press-on assembly on the container neck 14 may preferably take the form of a container-engaging skirt 28 which depends downwardly from the imperforate top panel 26 at a location spaced marginally inward from the outer peripheral extremity thereof. Otherwise stated, the outer marginal portion of the endwall, or top panel, presents an annular overhang 27 which, as observed in FIG. 2, is arranged to extend laterally outward beyond the skirt 28 and the rim 16 of the container neck 14 on which the skirt 28 is assembled. On the underside of the overhang 27, a bearing surface 27*a* is presented, as will be later described, to facilitate removal of the closure member 10 from assembly on the container neck 14. The skirt 28 incorporates an inwardly-directed retaining bead 30 which is adapted to be pressed downward over the container neck and snap over the retaining bead 20 so as to reside in snug, snap-fit relationship within the recessed portion 24 on the neck 14 of the container 12. Thus, the top panel 26 and the skirt 28 combine to form a press-on type of snap cap which is adapted to sealingly engage and close the container 12. A tamper-indicating sleeve 32 is integrally connected to depend from the outer reaches a periphery of the top panel 26 in surrounding relationship with both the overhang 27 and the skirt 28. Significantly, as shown, the tamper-indicating sleeve 32 is not only structured to surround the overhang 27 and skirt 28, but also to extend downwardly beyond the depending end of the skirt 28. Thus, the tamper-indicating sleeve encloses the bearing surface 27*a* and the skirt 28 within the interior confines thereof and thereby isolates the same from manual accessibility which, as will be subsequently described, is required for manual removal of the closure member 10 from the container neck 14. Along the juncture or interconnection of the tamper-indicating sleeve 32 with the endwall, or top panel 26, there is a relatively thin web section 34 which provides a selectively weakened peripheral tear zone facilitating easy removal of the tamper-indicating sleeve 32 from the top panel 26. As observed in FIG. 1, the tamper-indicating sleeve incorporates at least one selectively weakened, major tear groove 36 which extends from the lower edge of the sleeve 32 to the peripheral tear zone bordering the outer edge of the top panel 26. A longitudinally shortened section, or portion 38, of the tamper-indicating sleeve 32, which is bordered or defined on one longitudinal side by the major tear groove 36, is formed so as to be shorter than the remaining portion of the tamper-indicating sleeve 32 and function as a tear tab to facilitate manual grasping of this portion. Also, the shortened portion 38 is preferably bordered, or defined, on its opposite longitudinal side or edge by a minor tear groove or slit 40. Thus, when it is desired to remove the tamper-indicating sleeve, the shortened portion 38, or tear tab, may be manually grasped and bent, or flexed, outwardly along the major tear groove 36. Upon application of further pulling force on the shortened portion 38, the tamper-indicating sleeve 32 may be severed, or torn, from the top panel 26 along the tear zone provided by the weakened web section 34. It should be noted that a plurality of additional minor tear grooves or slits 40 also may be formed in the tear-indicating sleeve, or tear band, 32 and positioned in interspaced array around the periphery or circumference thereof so that they will be subject to tear and serve as additional indicators of attempts to remove or tamper with the tamper-indicating sleeve 32** at other circumferential locations.

As best observed in FIGS. 2 and 3, the tamper-indicating sleeve 32 is sized so that it overlaps and is adjacent to the enlarged ledge 22 formed on the container neck 14. This feature further prevents access to the bearing surface **27*a* on the underside of the top panel 26 or to the skirt 28 and thus aids in precluding removal of the closure member from the container while the tamper-indicating sleeve 32 is still peripherally interconnected with the top panel 26. Also, when the tamper-indicating sleeve 32 is sized to snugly contact the ledge 22, the closure member is rendered insect infestation-proof. It should be noted further that the interior portion of the skirt 28 includes an inwardly directed protuberance 42 which functions to hold a liner (not shown) within the closure member when the use of such a liner is desired. Also, a plurality of reinforcing supports 44 are preferably positioned in interspaced array around the exterior periphery of the closure member and interconnect the bearing surface 27*a* on the underside of the top panel overhang 27 with the outersurface of the skirt portion 28. These supports 44 render the overhang 27 more rigid to aid in manual removal of the closure member 10** from the container.

Thus, while the tamper-indicating sleeve 32 remains connected to the endwall, or top panel, 26 of the closure member, as shown in FIGS. 1 and 2, it effectively precludes manual removal of the closure member 10 from assembled engagement with the container 12. On the other hand, when it is desired to remove the tamper-indicating sleeve 32, the shortened removal portion 38, or tear tab, may be manually grasped and bent or flexed upwardly and outwardly so that the grasping force is transmitted to the selectively weakened web section 34 at the junction thereof with the major tear groove 36. Thereafter, the tamper-indicating sleeve 32 may then be readily torn away from the endwall, or top panel, 26 by tearing it along the selectively weakened web section 34. Once the tamper-indicating sleeve has been removed, as can be seen in FIG. 3, easy access to the resulting exposed overhang 27 and bearing surface **27*a* is provided. Thus, a suitable lifting force may be manually exerted or applied to the overhang 27 and/or bearing surface 27*a* to accommodate disengagement of the closure member 10, or snap cap from the container. Moreover, it should be noted that the closure member may be replaced in sealing engagement with the container for reuse. Since the tamper-indicating sleeve 32 does not form a part of, or is not in contact with, the skirt portion 28, damage to the sealing relationship between the skirt portion 28 and the container neck 14 is eliminated by the closure structure of the present invention. No less importantly, the undisturbed presence of the tamper-indicating sleeve 32 provides assurance to the consumer that the closure member has not been previously removed from the container, since the closure may not be manually removed until after the tamper-indicating sleeve has been irreplaceably severed from the endwall, or top panel, 26**.

Figure 5:
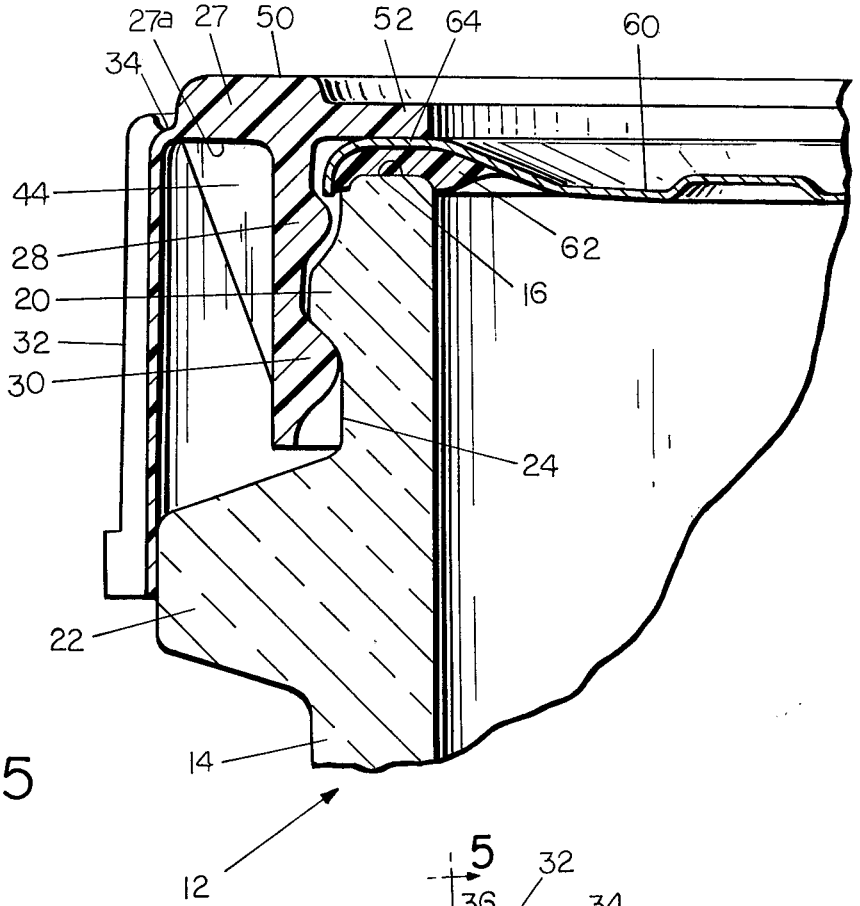
FIG. 5 is a fragmentary sectional view in substantially enlarged elevational aspect of the embodiment shown in FIG. 4, and depicting the same assembled on the neck portion of a container.
Figure 4:
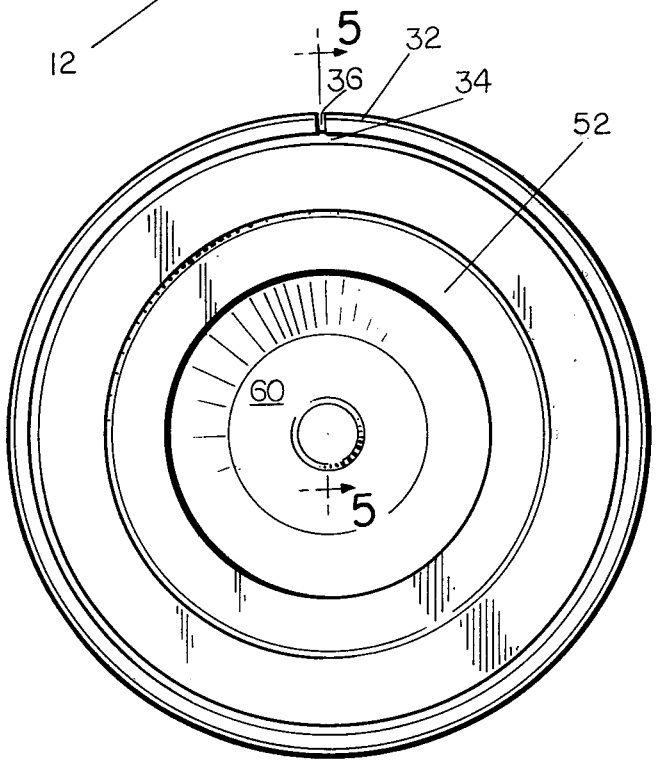
FIG. 4 is a top plan view of another preferred form of the invention and depicting the tamper-indicating sleeve as being embodied in a tamperproof, snap-on retaining ring for use in combination with a separate metal lid member.

The tamper-indicating features of the present invention also afford versatility in that they are also adaptable to embodiment in other types of press-on or snap-on closures. One such preferred alternative embodiment is depicted in FIGS. 4 and 5 wherein the tamperproof closure member is structured in the general form of a tamper-indicating ring such as may be employed for vacuum packing purposes for retaining a generally disc-shaped metal lid in hermetically or vacuum sealed assembly on a container. For purposes of clarity of understanding and in the interest of brevity, various parts of the closure member which are the same or essentially the same in manner of structure and function as the embodiment shown in FIGS. 1–3 are not redescribed, but rather are referred to herein and designated in FIGS. 4 and 5 by the same reference designations shown and alluded to in FIGS. 1–3. In more particular detail, the closure member of this alternative embodiment is in the form of a double-walled annular plastic ring 50 which when assembled in snug, snap-fit relationship on the neck portion 14 of the container 12 is adapted to confine a separate generally disc-shaped central panel or metal lid 60 in air-tight sealing contact with the rim 16 of the container neck. As shown, such sealing contact is preferably implemented by the provision of an annular liner 62 of plastisol, or like pliant sealing material, positioned around the underside outer periphery of the metal lid 60 and adapted to be biased snugly against the rim 16 when the annular ring 50, with the lid 60 in place therein, is pressed or snapped into assembly on the container neck 16. Retention of the lid 60, with the liner 62 in sealing contact with the rim 16 of the container neck 14 is provided by a continuous annular endwall shoulder 52 bordering a central transverse opening extending through the endwall. As shown, the endwall shoulder 52 is deployed to overlie the rim 16 of the container neck and the outer margin 62 of the lid 60, whereby the outer margin 64 of the lid 60 will underlie the endwall shouldr 52 and the liner 62 will be tightly sandwiched and sealed against the rim 16 when the ring 50 is pressed or snapped into assembled position on the container 12.

Removal of the ring 50 and lid 60, as with the embodiment described in FIGS. 1–3, requires initial removal of the tamper-indicating sleeve 32 in order to achieve manual access to the outwardly overhanging portion of the endwall, or overhang 27, and/or bearing surface **27*a*, and which, as previously indicated, is necessary to accommodate manual removal of the closure member from the container. Moreover, as with the embodiment of FIGS. 1–3**, once a partial or total removal of the tamper-indicating sleeve has occurred such fact will be readily evident to subsequent prospective users or purchasers of the container package. Conversely, when the tamper-indicating sleeve is unimpaired, there is assurance that package integrity has been maintained.

It will, of course, be understood that various details of construction, combination and assembly may be modified throughout a range of equivalents, and it is, therefore, not the purpose to limit the scope of the present invention otherwise than as necessitated by the scope of the appended claims.

I claim:

1. A tamperproof closure member for assembly on a container neck having a rim defining an open mouth of the container, said closure member comprising:

an end wall;

retaining means carried by said end wall comprising an annular skirt depending downwardly from said end wall and being formed to fit in snap-fit relationship on said container neck to thereby retain said closure member in snug-fitting, removable assembly on said container neck;

an outer marginal portion of said end wall providing an annular overhang arranged to extend laterally outwardly beyond said retaining means, said overhang presenting a bearing surface against which to apply manual force in the axial direction for closure removal from said container neck;

an integral tamper-indicating sleeve depending from the outer peripheral edge of said end wall spaced outwardly from said downwardly depending skirt and enclosing said bearing surface within the interior confines thereof to thereby isolate said bearing surface from accessiblity for manual removal of said closure member from said container neck, said sleeve being substantially longer than said skirt and shaped to fit snugly against said container neck below said retaining means;

a selectively weakened section defined along the juncture of said tamper-indicating sleeve with said end wall, said weakened section being adapted to selectively tear in response to a manually applied tearing force and thereby accommodate sepration of said tamper-indicating sleeve from said end wall, whereby to permit manual access to said bearing surface for the removal of said closure member from said container neck, and provide a readily ascertainable indication of tampering with the closed container.

2. A tamperproof closure member as defined in claim 1, wherein said endwall includes an imperforate top panel integral with said other maginal portion, and wherein said endwall and said annular skirt and said tamper-indicating sleeve are integrally fabricated from a moldable plastic material to provide a closure member in the form of a one-piece snap cap.

3. In a snap cap for a container and finish encircling the opening therefor having an annular cap retaining bead, and axially spaced ledge, said snap cap having an end wall and integral skirt including an inwardly directed annular bead thereon for closure retaining engagement with the said retaining bead on the container, the improvement therein comprising, a cylindrical tear sleeve downwardly depending integrally from said end wall, spaced outwardly from said skirt and extending axially beyond said skirt, said sleeve snugly engaging said container ledge downwardly of said container neck from its said cap retaining bead, a selectively weakened, peripheral tear zone in said sleeve adjacent the cap end wall, and including one axial tear groove extending from the peripheral tear zone through the lower edge of said sleeve, a longitudinal shortened section of said sleeve being located adjacent said axial tear groove providing a shortened section of said sleeve at its lower end, whereby the sleeve may be grasped and torn axially for closure removal and for indicating tampering.

4. The closure improvement of claim 3, in which the end wall is provided with a central aperture and said closure includes a separate underlying lid engaging the container about said end opening spaced above the annular cap retaining bead and is retained by said cap.

5. A tamper-indicating closure as set forth in claim 3, wherein said sleeve includes at least one axial tear groove defined along the other side of said shortened section.

6. A tamper-indicating closure as set forth in claim 3, wherein said sleeve includes a plurality of said axial tear grooves spaced about the periphery thereof.

* * * * *